US005564474A

United States Patent [19]

Dewispelaere

[11] Patent Number: 5,564,474

[45] Date of Patent: Oct. 15, 1996

[54] WEAVING LOOM HAVING AXIALLY DISPLACED SLEY LEGS

[75] Inventor: Andrè Dewispelaere, Marke, Belgium

[73] Assignee: N.V. Michel Van De Wiele, Kortrijk-Marke, Belgium

[21] Appl. No.: 315,622

[22] Filed: Sep. 30, 1994

[30] Foreign Application Priority Data

Sep. 30, 1992 [BE] Belgium ..... 9301028

[51] Int. Cl.[6] ..... D03D 49/60

[52] U.S. Cl. ..... 139/190; 139/188 R; 74/53

[58] Field of Search ..... 139/188 R, 190; 74/53

[56] References Cited

U.S. PATENT DOCUMENTS

| | | | |
|---|---|---|---|
| 2,833,315 | 5/1958 | Dunham | 139/188 R |
| 2,942,627 | 6/1960 | McDowell | 139/188 R |
| 3,858,621 | 1/1975 | Dvoracek et al. | 139/190 |

FOREIGN PATENT DOCUMENTS

| | | | |
|---|---|---|---|
| 895266 | 3/1983 | Belgium . | |
| 900016 | 10/1984 | Belgium . | |
| 2541695 | 8/1984 | France | 139/190 |
| 3205227 | 8/1983 | Germany . | |
| 1416550 | 8/1988 | U.S.S.R. | 139/188 R |

*Primary Examiner*—Andy Falik

*Attorney, Agent, or Firm*—Sughrue, Mion, Zinn, Macpeak & Seas

[57] ABSTRACT

A weaving loom with a sley having a defined weaving range, is provided with at least one first and one second sley leg (21; 22), respectively, for supporting the sley (2), the sley legs being arranged in the form of a deformable rectangle with hinge points at (A, B, C, D), and with a knee mechanism (10) for driving the sley (2). The knee mechanism is rotatably connected to the sley leg (21), to the top side thereof, using a connecting rod (6), the sley legs being connected, at their respective base side, to a first and second reed rotary shaft (23; 24), both the reed rotary shafts (23; 24) running mutually parallel and being mounted on a cross girder (4).

7 Claims, 2 Drawing Sheets

WEAVING LOOM HAVING AXIALLY DISPLACED SLEY LEGS

BACKGROUND OF THE INVENTION

1. Field of the Invention

This invention relates to a weaving loom having an improved sley movement.

2. Description of the Prior Art

Weaving looms whose sley is driven by a knee mechanism are known. This knee mechanism is suitable for carrying out sley movement with double beat-up.

In Belgian Patent No. BE-895266 a weaving loom is disclosed in which the sley is provided with a pair of sley legs which are arranged in the form of a parallelogram support and the sley is further driven by such a knee mechanism which interacts with a cam. When the sley carries out such movement, the weaving reed maintains its vertical orientation during the oscillating beat-up movement, which takes place in the form of arcs on the sley legs with the parallelogram support. Using the knee mechanism, a large beat-up pressure force can be effected with a limited drive torque on the cam, as is well known in the field of mechanical presses.

However, a weaving loom of this kind has various disadvantages. In order to span a weaving width of large dimensions, this sley has to be designed such that it has great flexural stiffness, as only two drive points can be provided alongside the warp threads on both sides of the loom. Consequently, the sley has to be designed as a heavy girder supported by various parallelograms supporting legs which act as sley legs. Therefore, these sley legs do not contribute towards the flexural stiffness of the unit. In addition, the drive is only transmitted by two drive points which are located outside the fabric layer. This results in a considerable flexural strain on the sley. A sley construction of this kind is relatively heavy. This brings with it a high moment of inertia which has adverse effect on the weaving speeds and, in addition, also generates vibrations of the ground.

Document BE-900016 discloses a weaving loom which is provided with a sley having a parallelogram support and direct cam drive. With this weaving loom, effecting a double beat-up movement by means of the design of the cam profile is very difficult. The drive of the sley takes place over a large width by the twisting moment of one single reed rotary shaft. This reed rotary shaft thus has to be dimensioned to be large in order to be able to transmit the required twisting moment. Furthermore, the cam drives have to be fitted under the fabric layer in order to reduce the torsion arm. Fitting the drive groups under the fabric layer is relatively complicated and makes access for any repair work relatively difficult.

SUMMARY OF INVENTION

The object of the weaving loom according to the invention is to provide a solution for the above mentioned problems.

To this end, the weaving loom comprises a sley having a given weaving range determined in accordance with the sley, and at least one first and one second sley leg, respectively, for supporting the sley. The first and second sley legs, respectively, are arranged in the form of a deformable rectangle with hinge points at A, B, C, D. The weaving loom furthermore comprises a knee mechanism for driving said sley.

According to the invention, the knee mechanism is rotatably connected to said at least one first sley leg, to the top side thereof, by means of a connecting rod, the first and second sley legs, respectively, being connected, at their respective base side, to a first and second reed rotary shaft, respectively, both of the reed rotary shafts running mutually parallel and being mounted on a cross girder.

The weaving loom according to the invention offers the advantage that the sley does not have to be very flexurally stiff. The flexural strain is converted, via the parallelogram sley supporting legs, to a twisting strain on the reed rotary shafts acting in parallel and mounted on a flexurally and torsionally stiff cross girder. The sley may have a smaller mass, even for large weaving widths. Higher weaving speeds can thus be achieved. Another advantage of the weaving loom according to the invention is that less vibrations are passed on to the ground. The flexural moment and torsional moment are absorbed by the reed rotary shafts which are mounted on said flexurally and torsionally stiff cross girder.

Further embodiments are defined in the subclaims.

Further advantages and details of the weaving loom will become clear from the following description of an illustrative embodiment with reference to accompanying drawings.

DESCRIPTION OF THE PREFERRED EMBODIMENT

Figure 1:
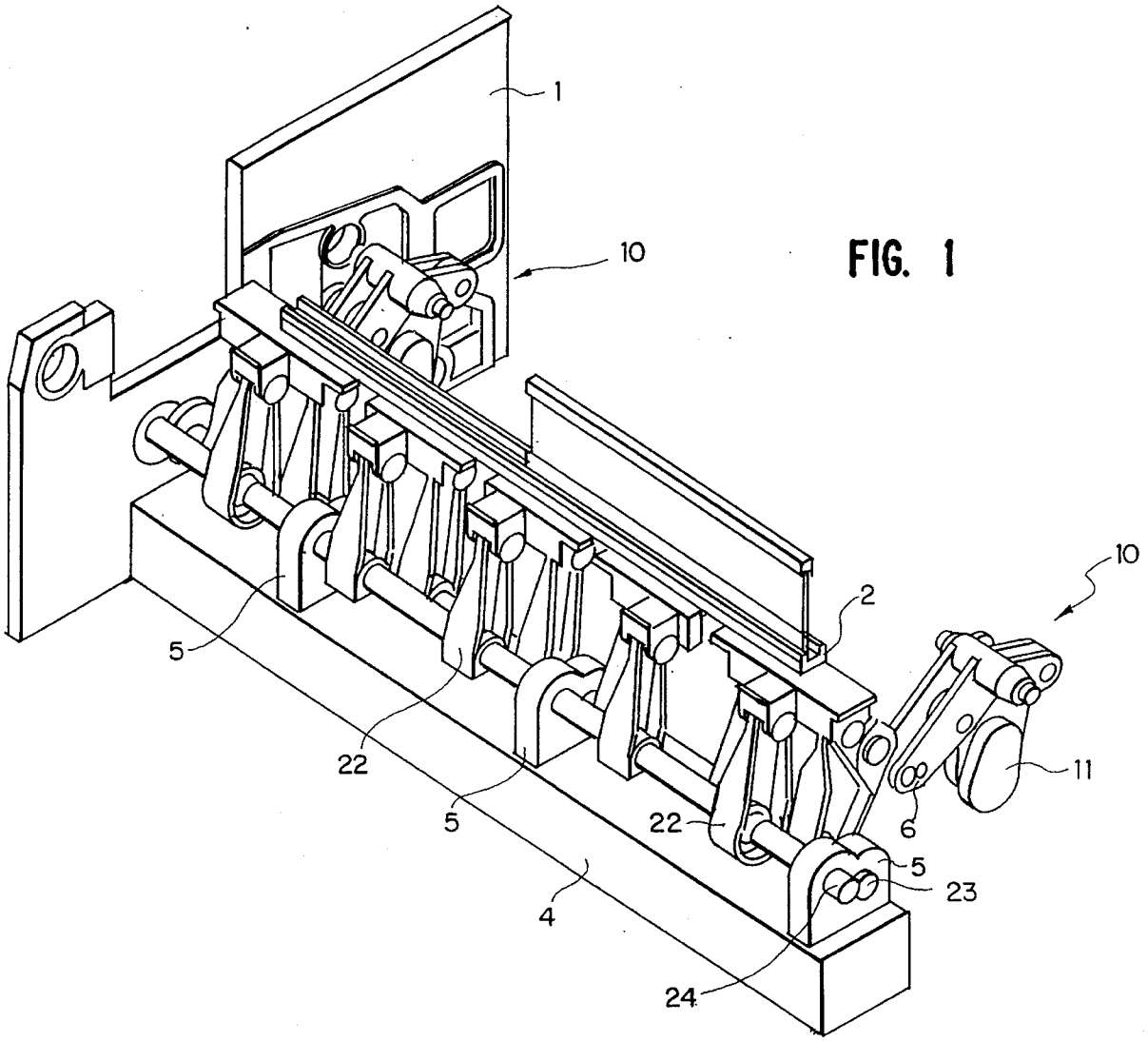
FIG. 1 is a schematic representation of a part of the weaving loom according to the invention.

FIG. 1 shows a general perspective view of the part of a weaving loom in which elements according to the invention have been incorporated.

the weaving looms in question are weaving looms which achieve great weaving speeds, which generate a large beat-up pressure force with a small drive torque on the drive mechanism 10, in particular a cam 11 as illustrated in FIG. 1.

The weaving loom is fitted on a frame 1 and is provided with a sley 2 which executes an oscillating beat-up movement in the form of arcs between a beat-up position and an open position. The sley movement takes place in such a manner that the weaving reed 3 maintains a virtually vertical orientation, at least in the final positions. The sley 2 is supported by a pair of elongated sley legs 21, 22 which extend transversely relative to the sley towards a cross girder 4, and are fixedly connected to the reed rotary shafts 23, 24 which are mounted on the cross girder 4. The sley legs are distributed along the longitudinal direction of the sley and are fixedly connected to reed rotary shaft 23, 24, respectively. The reed rotary shafts mounted on bearing blocks 5 on the cross girder, which runs virtually parallel with the sley.

Figure 2:
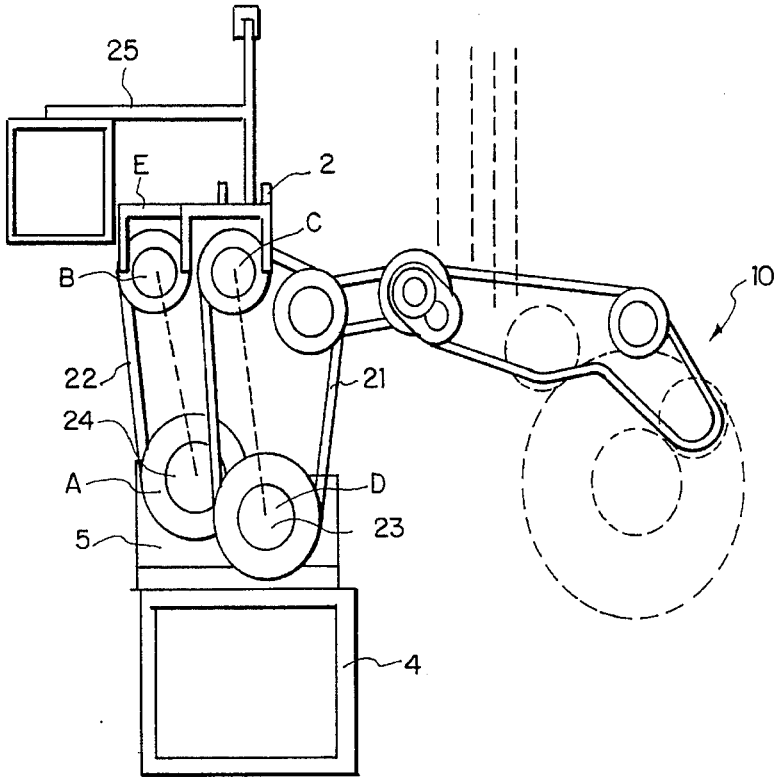
FIG. 2 is a side view of the representation according to FIG. 1 with the reed in the beat-up position.
Figure 3:
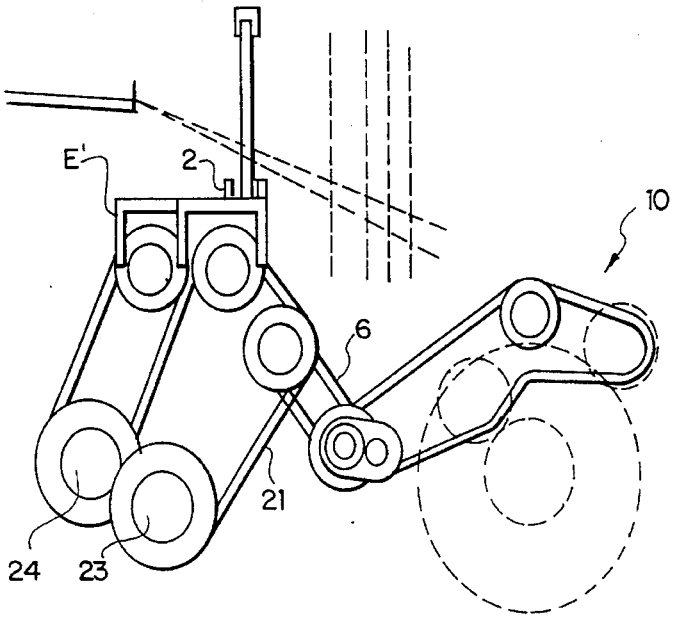
FIG. 3 is a representation analogous to that of FIG. 2 with the reed in the open position.

FIGS. 2 and 3 show a knee mechanism 10 in two different positions E, E', which serves as drive mechanism for the sley.

As mentioned above, the knee mechanism is very suitable for a sley movement with double beat-up. The knee mechanism interacts with a cam (and is known per se, as mentioned). The knee mechanism is hingedly connected on its one end to a connecting rod 6 which is directly connected to one of said first sley legs 21. The knee mechanism is thus mechanically connected to the sley via the sley legs 21. As a result, even with a limited drive torque on said cam, a large beat-up pressure force can be achieved by means of the knee mechanism, in which case the large beat-up pressure force produced can be transmitted to the sley via said sley leg. In order to distribute the beat-up pressure force over the weaving range of the weaving loom, two knee mechanisms are preferably provided, which are arranged at both longitudinal ends, respectively, of the sley. This is illustrated in FIG. 1. This results in a more regular and homogenous transmission of power.

FIGS. 2 and 3 furthermore show that said first sley leg 21 interacts in each case with a second sley leg 22 and, more particularly, in the form of a deformable rectangle, preferably a trapezium with hinge points A, B, C, D.

The action of force absorbed by said first sley leg 21 is transmitted to said second sley leg 22 by means of this mutual rectangular arrangement of said first and second sley legs, respectively. Thus, a distribution of the flexural strain over the first and second sley legs 21 and 22, respectively, is achieved which is, in addition, converted to a twisting strain on both reed rotary shafts 23, 24 acting in parallel.

The reed rotary shafts are mounted on the flexurally and torsionally stiff cross girder 4, via bearing blocks 5. Consequently, the flexural moment and the torsional moment are absorbed by both parallel reed rotary shafts, which are mounted on the cross girder which is, in turn, both flexurally and torsionally stiff. Thus, the requirement of flexural stiffness of the sley becomes less stringent, i.e. the above mentioned problem of a very much higher flexural stiffness of the sley is thus solved. The sley can thus be constructed to have a smaller mass, even if a large weaving width is required. Due to the permitted smaller mass of the sley, the weaving speed can be increased significantly. A further advantage in this case is the fact that less vibration is produced, which has a positive effect on the working environment.

In this case, the two reed rotary shafts run uninterrupted at least over the entire width of the weaving range, as is shown in FIG. 1. This results in an excellent transmission of the flexural moment and the torsional moment onto said cross girder 4.

Furthermore, both reed rotary shafts are preferably mounted on one-piece bearing blocks 5 which are arranged at a regular distance from each other and are fixed to said cross girder.

Preferably, both reed rotary shafts are fixed at one end in the main frame 1 and at the other end in one of said bearing blocks, as illustrated in FIG. 1.

The second reed rotary shaft 24 is fitted slightly higher than the first reed rotary shaft 23 relative to the cross girder 4. Sley legs 22 is therefore slightly shorter than sley leg 21, as a result of which the weaving reed is inclined slightly forward from the vertical position during the movement. With the beat-up movement, a bar will thus tend to be pushed down, as a result of which the chances of its breaking out are limited.

In addition, the first and second sley legs 21, 22, respectively, are mutually axially displaced, in such a manner that the trapezium configuration ABCD is sufficiently flat, i.e. the height or distance between side AB and side CD is not toe great. In this way, this mechanism can be constructed in a compact manner and the top side BC can move into the space under the work top 25 during the beat-up movement. Moreover, rolling bearings can be inserted in the bearing blocks 5 without the distance between the pivots A and D having to be increased. This permits the rotary shafts 23, 24 to be large without the distance between A and D having to be increased.

In the mutually axially displaced configuration of the first and second sley legs, respectively, one first sley leg 21 can be provided for each second sley leg 22, in each case upwards or downwards relative to the main frame 1, or alternately upwards and downwards. It is also possible to provide two first sley legs for a number of second sley legs, in which case one is arranged upwards and the other one downwards relative to the second sley leg 22, as is shown in FIG. 1, in particular on both ends of the sley 2. One of the two second sley legs, in particular the two second sley legs arranged at the extreme ends, serves as a connecting piece for the transmission of the drive of both knee mechanisms 10 arranged there.

I claim:

1. Weaving loom comprising; a main frame, a cross girder coupled to said main frame a sley having a weaving range, at least one first and one second sley leg (21; 22), respectively, for supporting the sley (2), said first and second sley legs (21; 22), respectively, being arranged in the form of a deformable rectangle with hinge points, a knee mechanism (10) for driving said sley (2), said knee mechanism (10) rotatably connected to said at least one first sley leg (21) at the top side thereof, by a connecting rod (6), said first and second sley legs (21; 22), respectively, being connected, at a respective base side thereof, to a first and second reed rotary shaft (23; 24), respectively, both of said reed rotary shafts (23; 24) running mutually parallel and being mounted on said cross girder (4).

2. Weaving loom according to claim 1, characterized in that said first and second reed rotary shafts (23; 24), respectively, run uninterrupted at least over the entire width of said weaving range.

3. Weaving loom according to claim 1, characterized in that said knee mechanism (10) is hingedly connected to said first sley leg (21).

4. Weaving loom according to one of claims 1 to 3 inclusive, characterized in that said knee mechanism (10) is provided at both longitudinal ends of said first and second sley legs.

5. Weaving loom according to claim 1 or 2, characterized in that both said parallel reed rotary shafts (23; 24, respectively) are mounted on a pair of one-piece bearing blocks (5) which are arranged at a fixed distance from each other.

6. Weaving loom according to claim 1 or 2, characterized in that both said parallel reed rotary shafts (23; 24) are mounted at one end thereof on the main frame (1).

7. A weaving loom comprising; a main frame, a cross girder coupled to said main frame a sley having a weaving range, at least one first and one second sley leg (21; 22), respectively, for supporting the sley (2), said first and second sley legs (21; 22), respectively, being arranged in the form of a deformable trapezium with hinge points, a knee mechanism (10) for driving said sley (2), said knee mechanism (10) rotatably connected to said at least one first sley leg (21) at the top side thereof, by a connecting rod (6), said first and second sley legs (21; 22), respectively, being connected, at a respective base side thereof, to a first and second reed rotary shaft (23; 24), respectively, both of said reed rotary shafts (23; 24) running mutually parallel and being mounted on said cross girder (4).

* * * * *